United States Patent [19]

Moran

[11] 4,446,964

[45] May 8, 1984

[54] METHOD OF PACKAGING ELBOW-SHAPED MEMBERS AND PACKAGE MADE THEREBY

[76] Inventor: Thomas F. Moran, 540 Cobblestone, Aurora, Ohio 44202

[21] Appl. No.: 186,701

[22] Filed: Sep. 12, 1980

[51] Int. Cl.[3] ..... B65D 85/46

[52] U.S. Cl. ..... 206/321; 206/597; 206/443

[58] Field of Search ..... 206/443, 321, 593, 386

[56] References Cited

U.S. PATENT DOCUMENTS

| | | | |
|---|---|---|---|
| 2,059,390 | 11/1936 | Pagel | 206/443 |
| 2,340,422 | 2/1944 | Okonski | 206/321 |
| 2,728,452 | 12/1955 | Kantola et al. | 206/443 |
| 3,220,583 | 11/1965 | Robertson | 206/443 |
| 4,195,732 | 4/1980 | Bell | 206/443 |

FOREIGN PATENT DOCUMENTS

| | | | |
|---|---|---|---|
| 2227205 | 1/1974 | Fed. Rep. of Germany | 206/443 |
| 2367674 | 12/1978 | France | 206/443 |
| 2807906 | 8/1979 | France | 206/443 |
| 442965 | 5/1975 | U.S.S.R. | 206/443 |

*Primary Examiner*—Joseph Man-Fu Moy

*Attorney, Agent, or Firm*—Pearne, Gordon, Sessions, McCoy, Granger & Tilberry

[57] ABSTRACT

A method of packaging tubular elbows is disclosed in which the elbows are stacked on a bottom frame in a parallel relationship, with each elbow facing the same direction. A top frame is placed on top of the elbows and the top and bottom frames are secured together by straps or other means to form a secure package. Preferably, the elbows are initially secured together into small bundles of about five elbows each before they are stacked in place to facilitate stacking and to provide a smaller quantity of bundles for subsequent distribution. The elbows may be packaged on a fixture having a pair of parallel posts between which the elbows may be stacked. The package produced by the method is also disclosed. The resulting package utilizes the inherent strength of the elbows to form a secure package, and the elbows are stacked in a nesting relationship to minimum the amount of space occupied by the elbows.

4 Claims, 7 Drawing Figures

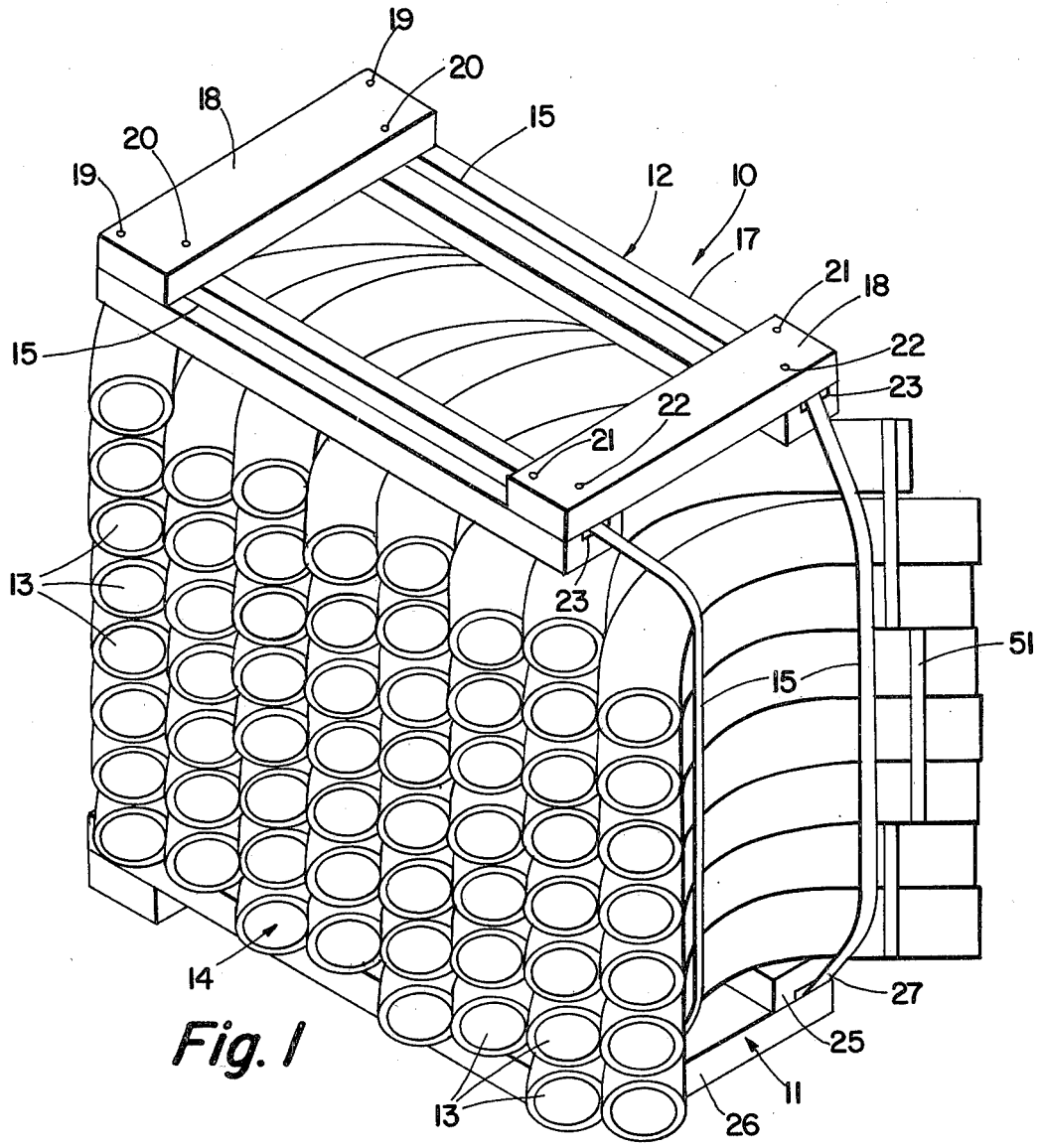
Fig. 1
Fig. 2
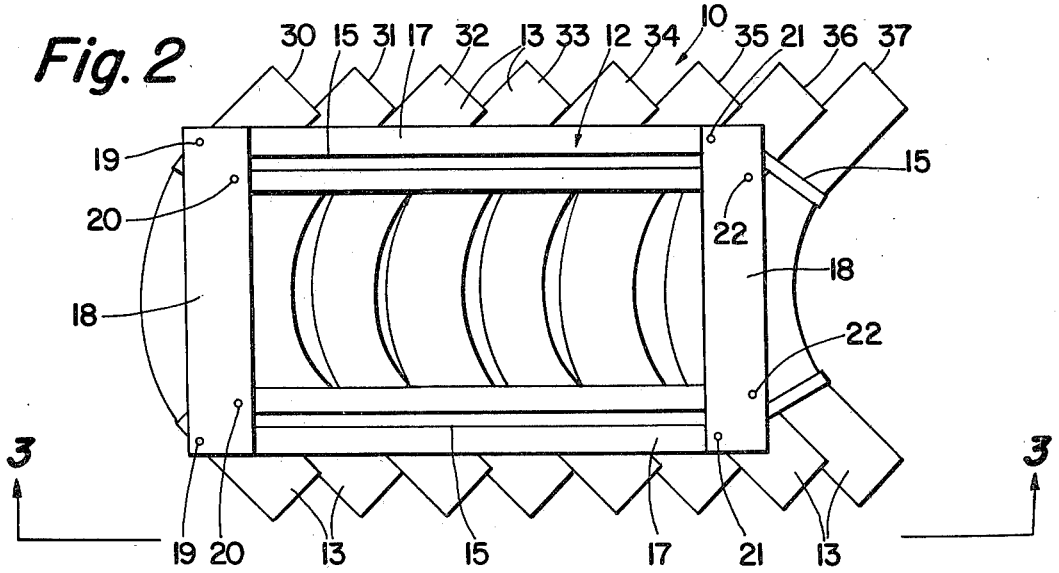

METHOD OF PACKAGING ELBOW-SHAPED MEMBERS AND PACKAGE MADE THEREBY

FIELD OF THE INVENTION

This invention relates to the packaging of unusual shaped articles, and in particular, a method of packaging elbows for shipment and distribution and to the package produced by the method.

BACKGROUND OF THE INVENTION

While the present invention is adapted for the packaging of any elbow-shaped article, it is especially useful in the packaging of tubular plastic elbows, such as those used in electric conduit, and the invention will be described with reference to such elbows. These tubular elbows are typically formed of a thermoplastic material such as polyvinyl chloride (PVC) and are used as insulating conduits for electrical cable or conductors. PVC elbows are produced in a range of sizes, typically having a diameter of 2½ inches to 4 inches. The elbows are usually formed with a 90-degree bend, but larger or smaller bends are also occasionally used.

PVC elbows are produced at a manufacturing facility and then shipped to a distribution center or to the installation site. Due to the large and cumbersome shape of the elbows, it has been difficult to provide a package in which the elbows can be shipped. One of the most common methods of packaging PVC elbows for shipment has been to tape about five elbows together and ship them in that fashion, or put them loose into a rectangular container of cardboard or other heavy stock. One problem of shipping elbows in loose bundles of five or so elbows was that the bundles could not be stacked, and inefficient use was made of shipping space and warehouse space. When the elbows were placed in a loose fashion into a carton or other similar container, the cartons were usually incapable of being stacked more than two high due to the possibility of crushing the loosely filled containers. Further, the cartons could not be stored outside due to the adverse effects of inclement weather on the cardboard containers. In addition, when using any of these traditional shipping methods, a large amount of expensive shipping space and warehouse space was wasted, and the space requirements for a reasonable number of elbows was excessive.

SUMMARY OF THE INVENTION

The present invention provides a unique method for packaging elbows, such as PVC tubular elbows or other similarly shaped articles, in which the elbows are placed together in a package which eliminates wasted space as much as possible. The elbows are stacked together with each elbow facing the same direction and arranged in a nesting matrix or array in which the wasted space is minimized. The present invention also provides a packaging method in which the elbows can be packaged securely with the addition of only a top and bottom frame, typically formed of wood, and two metal straps around the package, so that additional packaging material is minimized, thereby minimizing packaging costs. Since cardboard containers or similar packaging are not used, the packages may be stored inside or outside in any weather.

The present invention also utilizes the inherent strength of the elbows as part of the package, resulting in a unitized package which is sufficiently strong to permit the packages to be stacked on top of each other, thereby freeing up a substantial amount of floor space and allowing the packages to be stacked during shipment. The invention takes advantage of the fact that PVC elbows are substantially stronger than most cartons in which they are contained. Therefore, the elbows themselves are used as part of the package and assist in providing the package with necessary strength.

The bottom frame of the package provides a pallet which allows the package to be handled by a single person using a two-wheeler or with a lift truck. The package can be handled by a lift truck from either side or from either end of the package. Since the final package is stable on almost all sides, it may be stored in any of five of six possible orientations.

The present invention provides a package in which the elbows are packed as efficiently as possible. The weight density of the package is greater than with other methods of packing elbows. Therefore, the invention provides a means for carrying more weight during shipment in the same shipping space, thereby increasing the payload in each shipping container.

The packaging of the elbows may be facilitated by initially securing a number of the elbows together into small bundles. Typically, the elbows are secured together in bundles of five elbows each. This allows the elbows to be stacked more easily during the packaging process. In addition, the small bundles may be used as smaller packages during subsequent distribution. A distributor who receives a package of elbows can sell the smaller bundles of elbows to contractors or the ultimate users, since contractors typically buy elbows in smaller quantities. However, the present invention permits the contractor or ultimate user to purchase a larger amount in the original package if a large order is required.

These and other advantages are provided by the present invention of a method of packaging elbows. In the method, the elbows are secured together into small bundles. Typically, there are five elbows in most bundles. A bottom frame is provided, and the bundles are stacked on the bottom frame in a parallel relationship to form a solid matrix in which all elbows face the same direction. Preferably, as the matrix is formed, the elbows will be arranged in a nesting fashion in which each elbow rests between two adjacent elbows so that the density of elbows is as great as possible. A top frame member is placed on the matrix, and the frame members are secured together with the matrix of elbows between the frames to form a secure package. Preferably, the frame members are secured together by straps. The method may be carried out on a fixture provided for this purpose.

The present invention also provides a unique package of elbows which is produced by the inventive method. The package comprises a bottom frame, and a matrix of elbows arranged on the bottom frame in a parallel nested relationship, with all of the elbows facing the same direction, and a top frame secured to the bottom frame with the elbows secured therebetween.

BRIEF DESCRIPTION OF THE DRAWINGS

FIG. 1 is a perspective view of the package of the present invention produced by the method of the present invention.

FIG. 2 is a top plan view of the package of FIG. 1.

DESCRIPTION OF THE PREFERRED EMBODIMENT

Figure 3:
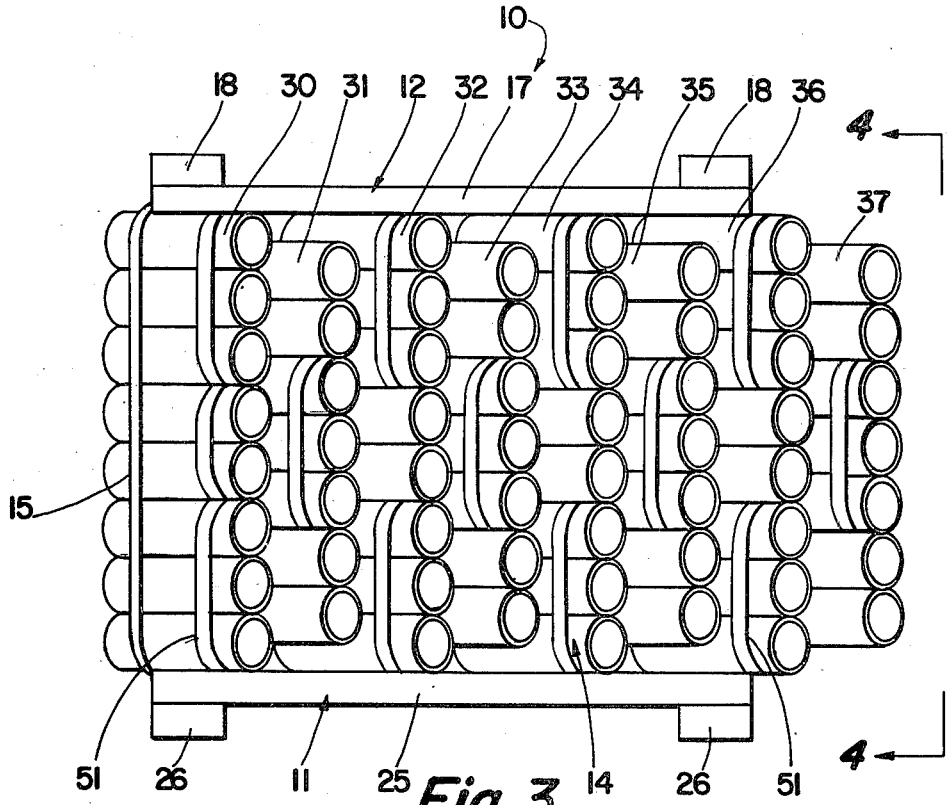
FIG. 3 is a side elevational view of the package taken along line 3—3 of FIG. 2.

Referring initially to FIG. 1, there is shown the package 10 of the present invention. The package 10 includes a bottom frame 11 and a top frame 12 on the bottom and top of a plurality of tubular elbows 13 stacked together to form a matrix 14. A pair of straps 15 extend through the bottom frame 11 and the top frame 12 and around the matrix 14 of elbows to hold the package securely together.

Figure 4:
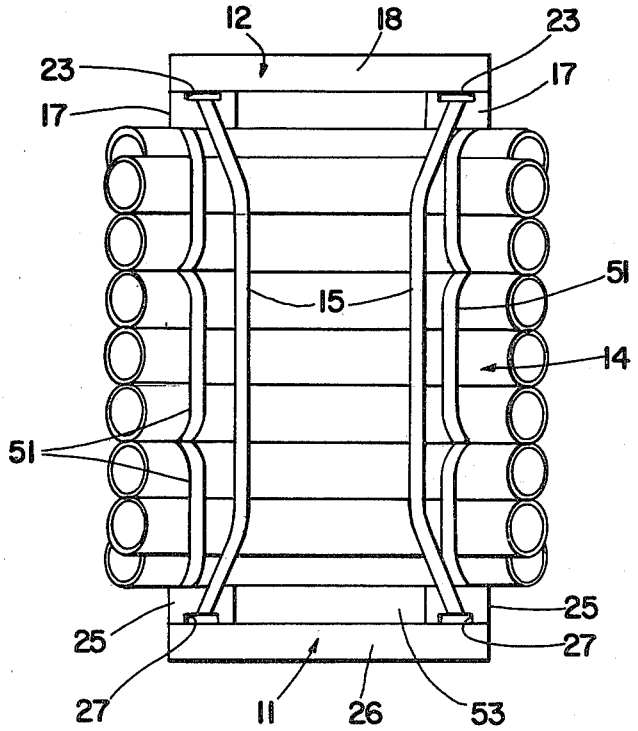
FIG. 4 is an end elevational view of the package taken along line 4—4 of FIG. 3.

The bottom frame 11 and the top frame 12 are essentially the same. As shown in FIGS. 1 and 2, the top frame 12 is formed of four pieces of lumber of suitable size to be capable of serving as crating or palletizing elements. A typical top frame 12 is formed of four pieces of two-by-four. The top frame 12 comprises two side frame members 17 of identical length and two end frame members 18 of identical length. The members 17 and 18 are arranged to form a rectangle when viewed from the top and are secured together such as by nails 19, 20, 21 and 22. Preferably, each of the side frame members 17 has a groove 23 (FIGS. 1 and 4) which extends longitudinally inwardly from each end of the member. Each groove 23 is used to contain one of the straps 15 and prevent lateral movement of the straps as the package is secured. One of the straps 15 extends on top of each side frame members 17, and extends beneath the end frame members 18 at the junction of the members 17 and 18. The straps 15 then extend downwardly around the matrix 14 of elbows to the bottom frame 11.

Due to the curved configuration of the elbows 13, the straps 15 tend to be pulled inwardly toward the center of the package 10 at one end of the package and tend to be pulled outwardly toward the sides of the package at the other end. For this reason, the nails 19–22 which secure the frame members 17 and 18 together are placed so as to prevent lateral movement of the straps 15. At one end of the package 10, where the straps 15 tend to be pulled outwardly away from the center and toward the sides of the package, the nails 19 are placed on the outside portion of the frame toward the sides of the package to assist in preventing outward lateral movement of the straps. At the other end of the package, where the straps 15 tend to be pulled inwardly toward the center of package, the nails 22 are placed away from the sides of the package and toward the center of the package to help prevent inward lateral movement of the straps. The placement of the nails 19 and 22 and the formation of the grooves 23 in the side frame members 17 together hold the straps 15 to the top frame 12 and prevent the straps from lateral movement, which would tend to loosen the package.

The bottom frame 11 is essentially the same as the top frame 12 and comprises a pair of side frame members 25 and a pair of end frame members 26 secured together with nails, which are placed to prevent lateral movement of the straps, the side frame members having grooves 27 to also prevent lateral movement of the straps.

Between the bottom frame 11 and the top frame 12, the plurality of tubular elbows 13 are stacked in the matrix 14. Each of the elbows 13 may be, for example, plastic or steel tubular elbows such as those used for electrical conduit. These elbows are typically formed of a thermoplastic material such as polyvinyl chloride (PVC) and may usually have a diameter of between 2½ inches to 4 inches, although they may sometimes be larger or smaller. Each elbow is bent to define an angle between its ends. Typically, this angle is 90°, but elbows having other angular dimensions are possible.

The elbows 13 are packed in a matrix 14 in which the elbows are arranged in a nesting relationship so that the elbows fit between each other and occupy as little space as possible. With reference to FIG. 3, it can be seen that the leftmost vertical column 30 of elbows extends from the bottom frame 11 to the top frame 12. The next vertical column 31 of the elbows to the right of the column 30 in FIG. 3 contains one less elbow than the column 30 and is arranged so that it is vertically offset with respect to the elbows in column 30 and each elbow in the column 31 fits or nests between two elbows in the column 30. Since each of the elbows in the column 31 is curved similarly to the elbows in the column 30, each of the elbows in the column 31 fits within the curvature of the elbows in the column 30 (FIG. 2). The next column 32 of elbows contains the same number of elbows as is contained in the leftmost vertical column 30 (FIG. 3). The elbows in the column 32 are arranged in a similar nesting fashion so that they fit between the elbows in the vertical column 31. The remaining vertical columns 33, 34, 35, 36 and 37 are arranged in a similar fashion. The vertical columns 31, 33, 35 and 37 each contain one less elbow than is contained in each of the vertical columns 30, 32, 34 and 36. The vertical columns 30, 32, 34, 36 are each the same, and may be called "first" vertical columns herein. The vertical columns 31, 33, 35 and 37 are each the same and may be called "second" vertical columns herein.

It is important that the top and bottom frames 11 and 12 be of the proper length with respect to the dimensions of the matrix 14. In particular, each side frame member 17 should extend from a position approximately above the middle of the leftmost first vertical column 30 of elbows to a position approximately in the middle of the rightmost first vertical column 36 of elbows as shown in FIG. 2. If the side frame members 17 are too short, one vertical column of elbows at either end of the matrix will not be secured by the frame and will tend to loosen during shipment. If the side frame members 17 are too long, the straps 15 will not extend over the elbows and the vertical column of elbows beneath the overhanging frame will not be secured by the straps.

While the matrix 14 shown in FIG. 3 contains eight vertical columns of elbows each having seven or eight elbows, providing a total of 60 elbows, it is understood that this may be the preferred arrangement for elbows of one particular dimension and that smaller or larger elbows may be arranged in a matrix having more or fewer vertical columns of elbows with more or fewer elbows in each column. The size and dimension of the matrix will depend upon the size of the elbows being packaged, and the desired size of the package. The size of the package will, in turn, be determined to optimize the shipping space available, and will depend upon the number of elbows which may be commercially packaged into a single package, the stability of the arrangement of elbows, and other factors. Typical packages will contain 60 or 75 elbows.

Figure 5:
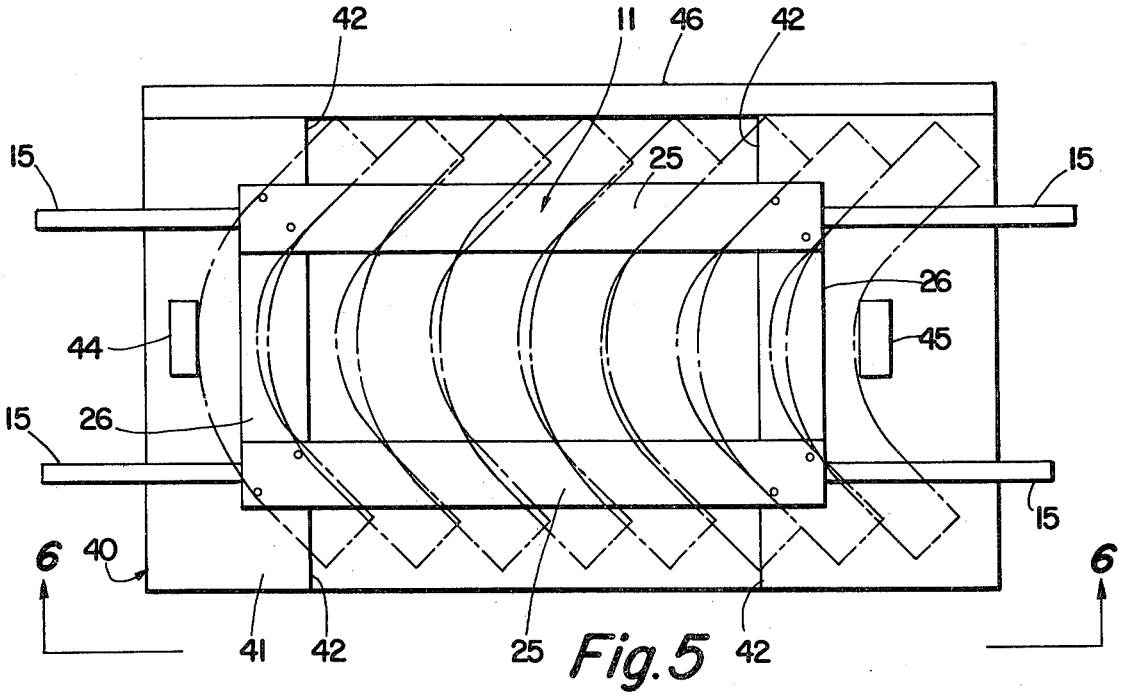
FIG. 5 is a top plan view of the fixture used in the method of the present invention.
Figure 6:
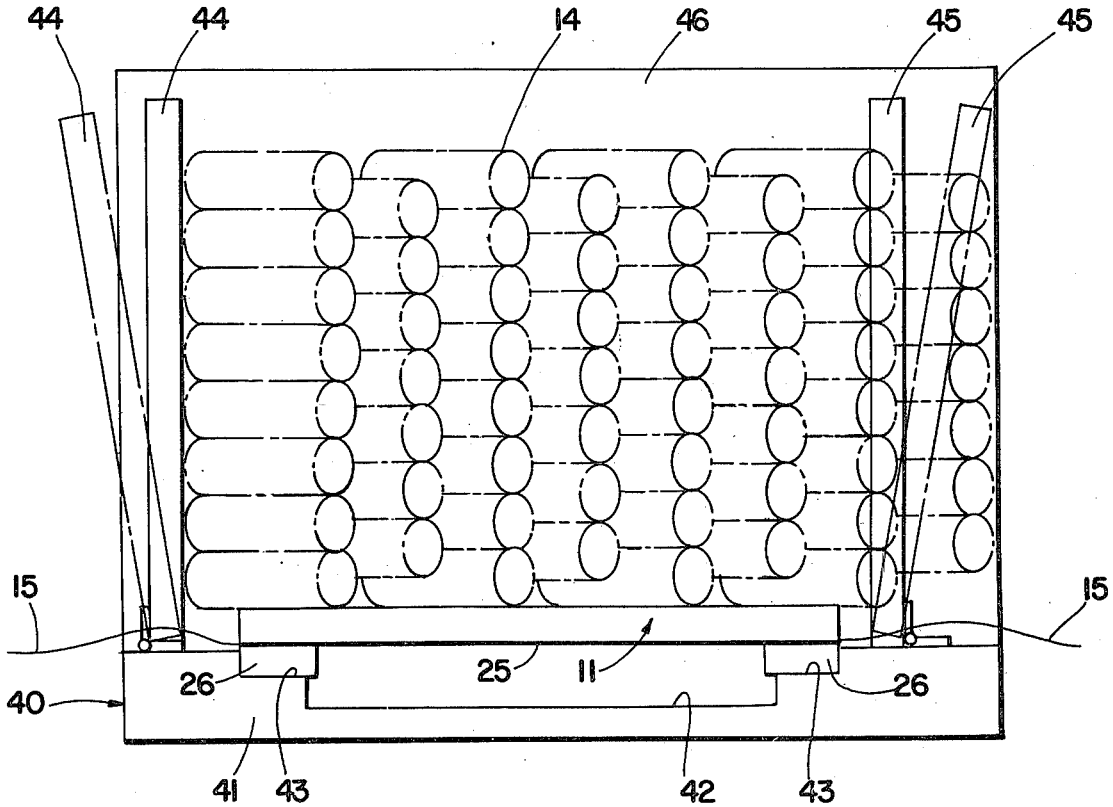
FIG. 6 is a side elevational view of the fixture taken along line 6—6 of FIG. 5.

The package 10 is formed in accordance with the method of the present invention. The method utilizes a fixture 40 which is shown in FIGS. 5 and 6. The fixture 40 comprises a base 41 having a central recess 42. On each side of the recess 42, a notch or step 43 is provided. The bottom frame 11 rests on the steps 43 (FIG. 6), and the recess 4 provides an access for a forklift which may be inserted into the recess 42 to lift the finished package. Extending upwardly from the base 41 on each side of the fixture 40 are a pair of posts 44 and 45. Each post 44 and 45 extends upwardly to approximately the same height as the matrix 14 of elbows. If desired, each post 44 and 45 may be hinged to allow the posts to be swung outwardly after the package is completed so that the posts do not interfere with the removal of the package, although this is not necessary to the function of the fixture. At the rear of the fixture 40, a rear wall 46 extends upwardly from the base 41 along the length of the fixture.

The distance between the posts 44 and 45 and the distance between the rear wall 46 and the posts is determined by the size of the package being formed. If a larger or smaller package is being formed, or if the package is being formed of elbows 13 having different dimensions, a fixture having different dimensions will be necessary. Preferably, the fixture 40 is designed with posts 44 and 45 and a rear wall 46 which are adjustable to accommodate packages of various sizes.

In the method of packaging the tubular elbows, a completed bottom frame 11 is placed in the fixture 40 with the frame resting on the steps 43 so that the frame is properly positioned between the posts 44 and 45. The completed bottom frame 11 has the straps 15 in place between the side frame members 25 and the end frame members 26. The ends of the straps are allowed to extend outwardly as shown in FIG. 5. With the bottom frame 11 in place, the posts 44 and 45 are secured in their full upright position and the tubular elbows 13 are stacked between the posts.

Figure 7:
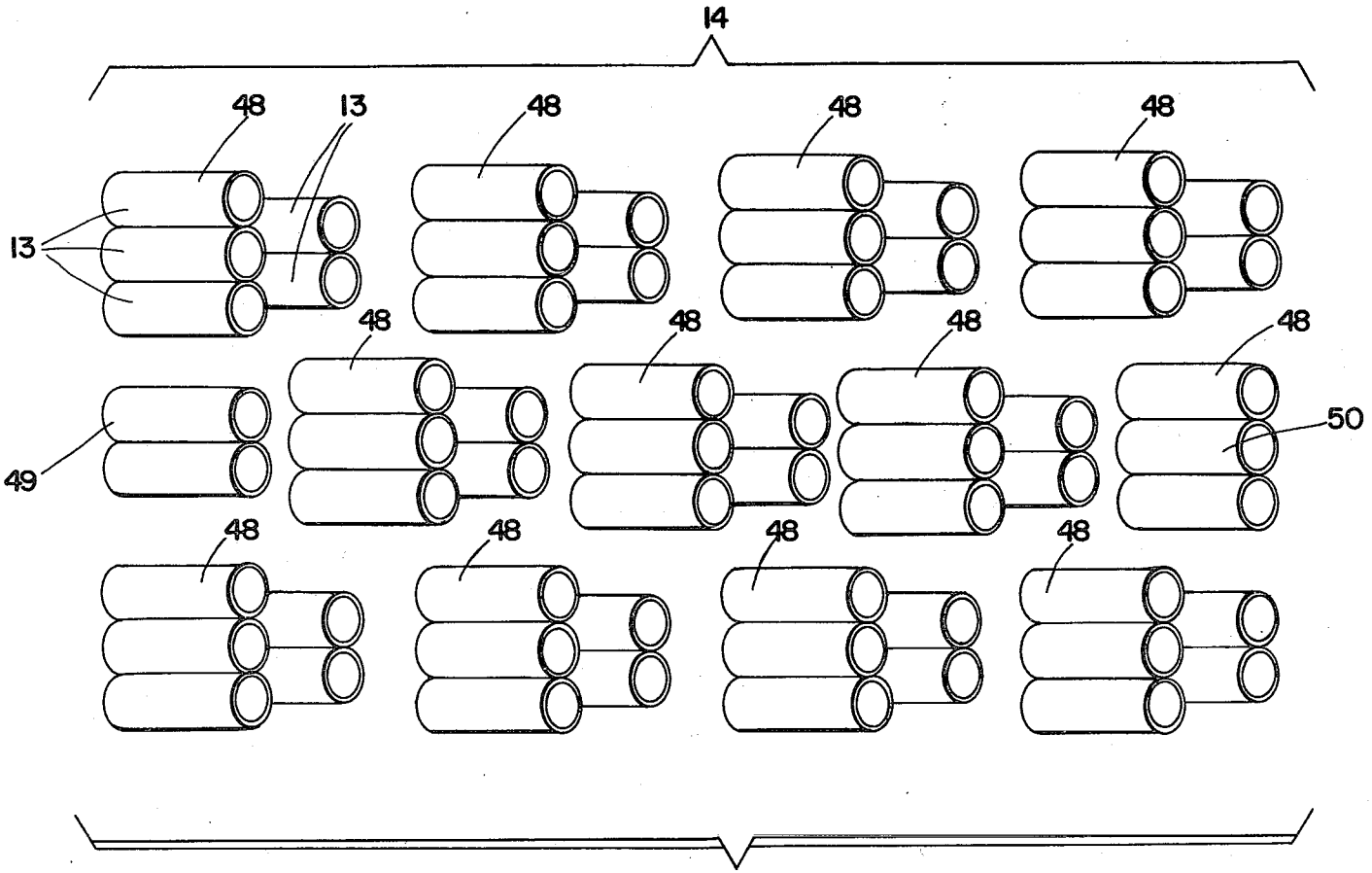
FIG. 7 is an exploded side elevational view of the matrix of elbows showing the individual bundles of elbows.

In accordance with the preferred form of the present invention, the elbows 13 are initially secured together into small bundles 48. Preferably, the elbows 13 are taped together into the bundles 48, as the elbows are formed. The bundles 48 are each secured together with tape 51 wrapped around each end (FIGS. 1, 3 and 4) and are then arranged in the matrix on the fixture 40 in the formation of the final package 10. Preferably, most of the bundles will have five tubular elbows. The five tubular elbows are arranged with three elbows in one vertical column and the other two elbows in a second vertical column arranged in a nesting relationship with the first vertical column. Examples of these bundles 48 can be seen in FIG. 7. To form a bundle 48 of five elbows, three elbows are taped together in a column, and two more elbows are taped together in a column, and the two sub-bundles are taped together to form the bundle 48 of five elbows. The bundles 48 are combined as shown in FIG. 7 to form a complete matrix 14. Due to the arrangement of the bundles in the matrix, it can be seen that bundles of fewer than five elbows are necessary at two places to complete the matrix. As shown in FIG. 7, a bundle 49 of two elbows is placed in the center of the left portion of the matrix and a bundle 50 of three elbows is placed in the center to the right of the matrix. As the individual bundles 48–50 are combined as shown in FIG. 7, they form the final matrix 14 as shown in FIG. 6. The bundles 48–50 are placed on the bottom frame 11 in the fixture 40 and are held in place between the posts 44 and 45.

As the bundles 48–50 are placed in the fixture between the posts 44 and 45, they are stacked against the rear wall 46. The wall 46 is positioned with respect to the posts 44 and 45 so that, as each of the tubular elbows touches the back wall 46, each elbow is properly positioned between the posts 44 and 45 and a symmetrical, properly proportioned package is formed.

When the matrix 14 is completed, the top frame 12 is placed on top of the matrix, preferably with the side frame members 17 and the end frame members 18 only loosely nailed together and the nails 19–22 partially driven in. The ends of the straps 15 are then drawn up and threaded between frame members 17 and 18 through the grooves 23 and come together on top of the side frame members 17. The straps are then tensioned by a conventional strap tensioning device and are secured together to form a solid package. Both straps 15 should be tensioned simultaneously, or the straps should be tensioned gradually, alternating between each strap, so that substantially equal tension is placed on each side of the package at approximately the same time to prevent uneven forces from developing in the package and forcing the elbows out toward one side of the package. As each strap 15 is tensioned, the strap pulls against the sides of the grooves 23 and 27 in the side frame members 17 and 25, rather than just against the nails 19 and 22. For this reason, it is preferred to provide the grooves 23 and 27 in the frames to prevent excessive lateral movement of the straps 15.

After the straps 15 have been tensioned, the top frame 12 is secured together driving in the nails 19–22 and securely nailing the side frame members 17 to the end frame members 18. This also helps prevent any further lateral movement of the straps 15.

After the package 10 has been secured together, a forklift can be inserted into the recess 42 on the fixture 40 to lift the package above the posts 44 and 45 and out of the fixture. If the posts 44 and 45 are hinged, they can be released and swung outwardly on their hinges prior to insertion of the forklift. During subsequent handling of the package 10, a forklift can also be inserted from the end of the package into the recess 53 (FIG. 4) formed between the side frame members 25 and the bottom row of tubular elbows. Thus, the package 10 may be lifted by a forklift from either side of the package or from either end of the package.

The finished package is also capable of being stacked in almost any orientation. Since the top and bottom frames 11 and 12 are essentially identical, the package can be stacked as formed or upside-down. Since each side is essentially flat, the package can also be stacked on either side. The package can also be stacked on the end containing the vertical column 37 having the outwardly extending ends of the elbows containing the vertical column 30. The only orientation in which the final package cannot be stacked is the end having the curved portion of the elbows. Due to the rounded configuration of this end, it cannot provide a stable base for the package.

It should be noted that the finished package 10 takes advantage of the structural advantages of the elbows and uses the stacked elbow matrix 14 as a major structural element in the final container. Due to the strength of the elbows and their ability to withstand most damage, the elbow matrix forms a more secure structure than any container in which the elbows may be placed. The package is also designed to take full advantage of the geometry of the elbows. The position of the straps 15 is such that, as more tension is applied to the straps, the matrix 14 becomes more compact and the final package becomes more secure. The geometry of the elbows produces tension in a diagonal direction across the package with the straps at the one end of the package pulled inwardly toward the center of the package and the straps at the other end of the package pulled outwardly toward the sides of the package.

Since the bottom frame 11 and the top frame 12 are formed of wood, and the strap 15 is formed of metal, the resulting package is impervious to most commonly encountered environmental conditions, and the packages may be stored outside without adverse effects.

The straps 15 have been described as conventional metal straps, such as are used in securing together various types of packages. Since metal has a coefficient of thermal expansion which is different from the plastic used to form the tubular elbows, it is possible that if the package were placed in extreme thermal conditions, the straps 15 may loosen or tighten and have adverse consequences upon the strength of the package or may damage the elbows. If this problem develops, it is possible to use plastic straps having a coefficient of thermal expansion approximately the same as that of the elbows 13.

While the preferred bundle 48 of elbows contains five elbows 13, it is possible that the bundles may contain more or fewer elbows. It has been found that five appears to be the optimum number of elbows used to form a bundle. When five elbows are arranged in a bundle 48 as shown in FIG. 7, they may be taped together with the tape 51 substantially in contact with each of the elbows 13 in the bundle. If more elbows were arranged in a bundle, it is possible that not all of the elbows would be in contact with the tape. If fewer elbows were arranged in a bundle, the bundle may be smaller than necessary. Five elbows also appears to be a useful number of elbows for use in subsequent sales by distributors of tubular plastic conduit. Using the present invention, a distributor may be able to open the package 10 and sell the elbows in groups of five without removing the tape therefrom.

The elbows 13 have been described as plastic tubular elbows such as those used in electric conduit. However, this invention is applicable to various types of articles having configurations approximately the same as the elbows disclosed herein. For example, the invention could be used with elbows formed of steel, copper or aluminum or other plastics, and could be used for rigid, curved rods in addition to tubular articles.

While the invention has been shown and described with respect to specific embodiments thereof, these are intended for the purpose of illustration rather than limitation, and other modifications and variations will be apparent to those skilled in the art all within the intended spirit and scope of the invention.

What is claimed is:

1. A package of elbows which comprises:

a bottom frame comprising a pair of side frame members and a pair of end frame members, the side frame members being spaced apart and connected to each other at each end by one of the end frame members, the bottom frame having a recess for insertion of a fork lift;

a matrix of elbows arranged on the bottom frame in a plurality of vertical columns of elbows alternatively divided into first columns and second columns, each of the second columns of elbows having one fewer elbow in it than each of the first columns, each elbow in each of the second columns being situated vertically between two adjacent elbows in the adjacent first columns so that the elbows nest together to occupy a minimum amount of space, each of the elbows being an elongated member which has a circular cross-section in which has a curved central portion and two straight portions on each end of the curved central portion making an angle of more than 15° with respect to each other, the straight portions of each of the elbows being contiguous with adjacent elbows, all of the elbows being of the same size and facing the same direction, the side frame members of the bottom frame extending in a direction parallel to the plane bisecting the angle between the straight portions of the elbows of the matrix, the bottom frame being capable of supporting the entire matrix of elbows; and a top frame located on the matrix of the elbows and comprising a pair of side frame members and a pair of end frame members, the side frame members extending in a direction parallel to the plane bisecting the angle between the straight portions of the elbows in the matrix of elbows, the side frame members being spaced apart and connected to each other at each end by one of the end frame members, the top frame being secured to the bottom frame by a pair of straps, each strap extending along one of the side members of the top frame and one of the side members of the bottom frame, the straps contacting the peripheral elbows in the matrix between the top and bottom frames, the top frame also capable of supporting the entire matrix of elbows when the package is inverted.

2. A package of elbows as defined in claim 1, wherein the matrix of elbows comprises a contiguous collection of small bundles of elbows separately secured together.

3. A package of elbows as defined in claim 1, wherein most of the bundles comprise five elbows taped together.

4. A package of elbows as defined in claim 1, wherein the side frame members of the top and bottom frames each have grooves at the ends within which the straps are held to prevent excessive lateral movement of the straps.

* * * * *

UNITED STATES PATENT AND TRADEMARK OFFICE

CERTIFICATE OF CORRECTION

PATENT NO. : 4,446,964

DATED : May 8, 1984

INVENTOR(S) : Thomas F. Moran

It is certified that error appears in the above-identified patent and that said Letters Patent is hereby corrected as shown below:

On the title the following should be added:

--[73] Assignee: McCoy William C. Jr., Hunting Valley, Ohio--.

Signed and Sealed this

*Eighteenth* Day of *September 1984*

[SEAL]

*Attest:*

GERALD J. MOSSINGHOFF

*Attesting Officer*

*Commissioner of Patents and Trademarks*